US009719036B2

(12) United States Patent
Chalabi et al.

(10) Patent No.: US 9,719,036 B2
(45) Date of Patent: Aug. 1, 2017

(54) WASTE PROCESSING

(75) Inventors: Rifat Al Chalabi, Nottingham (GB); Ophneil Henry Perry, Nottingham (GB); John Turner, Nottingham (GB)

(73) Assignee: CHINOOK END-STAGE RECYCLING LIMITED, Nottingham, Nottinghams (GB)

( * ) Notice: Subject to any disclaimer, the term of this patent is extended or adjusted under 35 U.S.C. 154(b) by 633 days.

(21) Appl. No.: 14/124,091

(22) PCT Filed: May 23, 2012

(86) PCT No.: PCT/GB2012/000457

§ 371 (c)(1),
(2), (4) Date: Mar. 27, 2014

(87) PCT Pub. No.: WO2012/168675

PCT Pub. Date: Dec. 13, 2012

(65) Prior Publication Data

US 2014/0202844 A1 Jul. 24, 2014

(30) Foreign Application Priority Data

Jun. 7, 2011 (GB) ..... 1109468.7

(51) Int. Cl.
*C10J 3/00* (2006.01)
*F27B 17/00* (2006.01)

(52) U.S. Cl.
CPC ..... *C10J 3/005* (2013.01); *F27B 17/0016* (2013.01); *C10J 2200/09* (2013.01); *C10J 2300/0946* (2013.01)

(58) Field of Classification Search
CPC ..... C10J 3/005; F27B 17/0016; F27B 7/10; C10B 1/10; C10B 49/04; C10B 49/06
(Continued)

(56) References Cited

U.S. PATENT DOCUMENTS 7,207,797 B2 * 4/2007 Perry ..... F26B 11/026 432/124
2012/0006669 A1 * 1/2012 Bronshtein ..... C10B 1/10 202/100

FOREIGN PATENT DOCUMENTS

JP 2003253267 10/2003

OTHER PUBLICATIONS

Examination Report Under Section 18(3) in relation to Application No. GB1109468.7 dated Dec. 21, 2011; 4 pages.
(Continued)

*Primary Examiner* — Jill Warden
*Assistant Examiner* — Julie Tavares
(74) *Attorney, Agent, or Firm* — Stetina Brunda Garred and Brucker

(57) ABSTRACT

Apparatus for pyrolyzing or gasifying the organic content of material, including organically coated waste, biomass, industrial waste, municipal solid waste and sludge, having organic content; the apparatus comprising: an oven having a rotatable portion comprising a treatment chamber adapted to receive material for treatment; a plurality of gas inlets in at least one wall (5) of the treatment chamber through which hot gases are introduced to the treatment chamber to heat the material therein so as to cause the organic components thereof to pyrolyze or gasify; and a plurality of pockets (8) having open faces turned inwardly towards the inside of the treatment chamber on at least one wall of the rotatable portion such that, in use, material being pyrolyzed or gasified can be received from the treatment chamber into the plurality of pockets (8) via said open faces, and be substantially retained therein through an initial rotation of the oven of less than 90 degrees.

15 Claims, 5 Drawing Sheets

(58) Field of Classification Search
USPC ..... 201/33, 36, 37; 202/100, 216, 249, 265; 34/108, 109; 432/124; 422/209
See application file for complete search history.

(56) References Cited

OTHER PUBLICATIONS

Examination Report Under Section 18(3) in relation to Application No. GB1109468.7 dated Sep. 14, 2011; 3 pages.
Combined Search and Examination Report Under Sections 17 and 18(3) in relation to Application No. GB1109468.7 dated Jun. 24, 2011; 5 pages.
PCT Search Report and Written Opinion of the International Searching Authority in relation to PCT/GB2012/000457 dated Oct. 5, 2012; 10 pages.

* cited by examiner

WASTE PROCESSING

The present invention relates to improvements in the processing of materials having an organic component. In particular the method relates to improvements in the processing of such materials in rotating ovens.

The use of large rotating ovens for processing waste is known in the prior art. Examples of rotating ovens for such use can be found, for example, in U.S. Pat. No. 7,207,797. This document discloses a rotating oven for processing waste which has a plurality of nozzles for omitting heated gas into the processing chamber thereof. Although only a single row of inlets is shown in this prior art document, in practice an array of inlets covering the sides of the processing chamber, or at least one side thereof, can be provided. As will be appreciated these types of ovens are substantially rectangular in shape as opposed to rotating drum type ovens. In rotating drum type ovens the material tends to tumble over itself, the bulk of the material sitting on the surface of the drum and offset from the centre line. As the oven rotates the material will tumble in a cyclic action but the bulk mass of the material will stay in substantially in the same place.

As the oven rotates scrap material therein will fall over the inlets temporarily blocking them and reducing the gas flow therethrough. In ovens of the sort described herein, i.e. substantially cuboid, or other shaped ovens having flat internal sides, when operating such a system as the material moves in the processing chamber as the oven is rotated it tends to move from one side to the other of the oven substantially as a single bulk movement i.e. once the stiction between the material to be processed and the surface it is resting on is overcome by the angle of the up and reaching a particular degree the entire mass of material will slide down that side of the oven and then substantially stop until the oven is further rotated so that the material once again overcomes its stiction. This can be disadvantageous in the speedy processing of waste material as while the material is substantially bunched together only the top and bottom surfaces of the material are exposed to the hot gases and therefore become heated to react and release gas.

As described in the prior art, the processing chamber can be a double-walled chamber that has hot gases passing between an inner and outer wall thereof so as to heat the inner wall. As the materials that are being processed come into contact with this inner wall, then heat is transferred from the exhaust gases circulating between the two walls into the material by its contact with the hot inner wall. Further, as described above, as the material within the oven tends to move as a single mass, only a small part of the inner wall is in contact with the waste material at any one time, thereby reducing heat transfer efficiency into displaced material.

It is the purpose of the present invention to provide an improved apparatus and method for processing waste that at least partially mitigates some of the above-mentioned problems.

According to a first aspect of the invention there is provided an apparatus for pyrolysing or gasifying the organic content of material having organic content including organically coated waste, biomass, industrial waste, municipal solid waste and sludge; the apparatus comprising: an oven having a rotatable portion comprising a treatment chamber adapted to receive material for treatment; a plurality of gas inlets in at least one wall of the treatment chamber through which hot gases are introduced to the treatment chamber to heat the material therein so as to cause the organic components thereof to pyrolyse or gasify; and a plurality of pockets having open faces turned inwardly towards the inside of the treatment chamber on at least one wall of the rotatable portion such that, in use, material being pyrolysed or gasified can be received from the treatment chamber into the plurality of pockets via said open faces, and be substantially retained therein through an initial rotation of the oven of less than 90 degrees The treatment chamber may have at least one substantially flat internal side and said plurality of pockets may be located on said flat side.

The exact reaction causing the breakdown of the organic material within the processing chamber will depend upon the processing chamber conditions. If there is zero or substantially zero oxygen present in the processing chamber, then the reaction will be predominantly a pyrolysis reaction. Where there is some oxygen present, there will be a gasification which will include some oxidation. In either reaction a gas will be produced that can be used as described in the prior art.

The pockets slow the movement of waste material as the oven rotates. Without the pockets of the invention, the oven would rotate until such point that the gravitational forces on the waste material therein overcame the stiction forces resisting movement of that material. Once the stiction forces are overcome then, without the pockets, the material would move substantially as one solid mass from its current position to a new position substantially at the lowest point of the chamber. When the treatment chamber has flat sides this effect is amplified as the material can slide from one side of the treatment chamber to the other. The pockets capture an amount of material therein and essentially hold the mass of material in each of the pockets until such time that the volume has been decreased by the gasification process. The pockets extend the time period for which the waste material is in contact with the sides of the processing chamber, and the pocket walls, as the oven rotates and increases the contact surface area of the material being processed with the heated chamber surfaces. By increasing the surface area of the material being processed, greater heat exchange can take place between the hot gases and the material. The only way for the material to fall out of the pocket would be to turn the chamber fully to or through 90 degrees so that the pockets are vertical or over vertical such that the material falls out under the action of gravity from the open face side of the pocket.

Preferably the treatment chamber has a double wall, comprising an inner wall and an outer wall, extending along at least one of its sides and wherein the pockets are formed on the inner wall so that the inner wall forms a bottom surface of said pockets. In this manner hot gases can flow between the inner and outer wall thereby heating the surfaces of the treatment chamber. The pockets may further comprise side walls extending from the inner wall. The side walls may be hollow and be in fluid communication with the gap between the inner and outer walls so that hot gas also passes through the side walls thereby heating them.

In one arrangement the gas inlets can be provided on the bottom surface of the pockets. Alternatively, or in addition, the gas inlets may be provided on the side walls of the pockets. The inlet hot gas penetrates the quantity of waste material from all sides and below, thus breaking the volume down.

Preferably the plurality of pockets is provided in a series of adjacent rows which may be offset from one another.

In one embodiment the adjacent rows of pockets are aligned perpendicular to the axis of rotation and a gap is provided between adjacent pockets in the same row. This allows the material to flow out of the gap between the pockets under the action of gravity as the chamber rotates. The gaps between adjacent pockets prevent material larger than the gap from passing from one pocket to the next pocket as the oven moves through said initial rotation.

Preferably the pockets taper in the direction of said gap. This promotes bridging of the material to restrict it from passing through the gap. The angle of the taper is preferably between 45 and 90 degrees and may vary depending on the material being used. In one embodiment the pockets are substantially rhombus shaped.

Preferably the pockets of adjacent rows have a common sidewall. The common side walls may comprise a hollow wall structure with a plurality of gas inlets located on either side thereof.

Preferably pockets are provided on at least two walls of the rotatable portion.

The rotatable portion may comprise at least one substantially planar internal side and the pockets are provided on the wall of that side According to a second aspect of the invention there is provided a method of pyrolysing or gasifying the organic content of material having organic content including: organically coated waste, biomass, industrial waste, municipal solid waste and sludge; the method comprising: providing an apparatus comprising: an oven having a rotatable portion comprising a treatment chamber adapted to receive material for treatment; a plurality of gas inlets in at least one wall of the treatment chamber through which hot gases are introduced to the treatment chamber to heat the material therein so as to cause the organic components thereof to pyrolyse or gasify; and a plurality of pockets having open faces turned inwardly towards the inside of the treatment chamber on at least one wall of the rotatable portion that, in use, material being pyrolysed or gasified can be received from the treatment chamber into the plurality of pockets via said open faces, and be substantially retained therein through an initial rotation of the oven of less than 90 degrees; placing material to be treated in the oven; heating the material in the treatment chamber by introducing hot gases thereinto via said plurality of holes; and rotating the oven so as to cause the material therein to move; wherein at least some of the material is received in the pockets so that the pockets retard the movement of the material in the processing chamber as it rotates.

Preferably the treatment chamber has substantially flat internal sides and the pockets slow the movement of waste material as the oven rotates to prevent the material therein from moving substantially as one mass from its position to a new position substantially at the lowest point of the chamber.

Preferably the treatment chamber has a double wall, comprising an inner wall and an outer wall, extending along at least one of its sides and wherein the pockets are formed on the inner wall so that the inner wall forms a bottom surface of said pockets, the gas inlets being provided on the bottom surface of the pockets, and the method comprises introducing the hot gases via the inlets on the bottom surface of the pockets.

Preferably the pockets of the apparatus further comprise side walls extending from the inner wall and the gas inlets are provided on the bottom surface of the pockets, and the method further comprises introducing hot gas through the plurality of holes in the side wall The plurality of pockets may be provided in a series of adjacent rows with a gap being provided between adjacent pockets in the same row, and the oven may be rotated in a direction perpendicular to the rows.

In this manner hot gases can flow between the inner and outer wall thereby heating the surfaces of the treatment chamber. In addition hot gases can pass through inlets into the interior of the processing chamber.

As discussed above by retarding the movement of waste material in the processing chamber in this way greater surface area to volume ratio of waste product is exposed to the hot gases and the heated sides of the waste processing chamber.

The hot gases pass through flow paths in the pockets, thereby directly delivering hot gas into the material being processed.

Specific embodiments of the invention will now be described, by way of example only, with the reference to the accompanying drawings in which.

Figure 1:
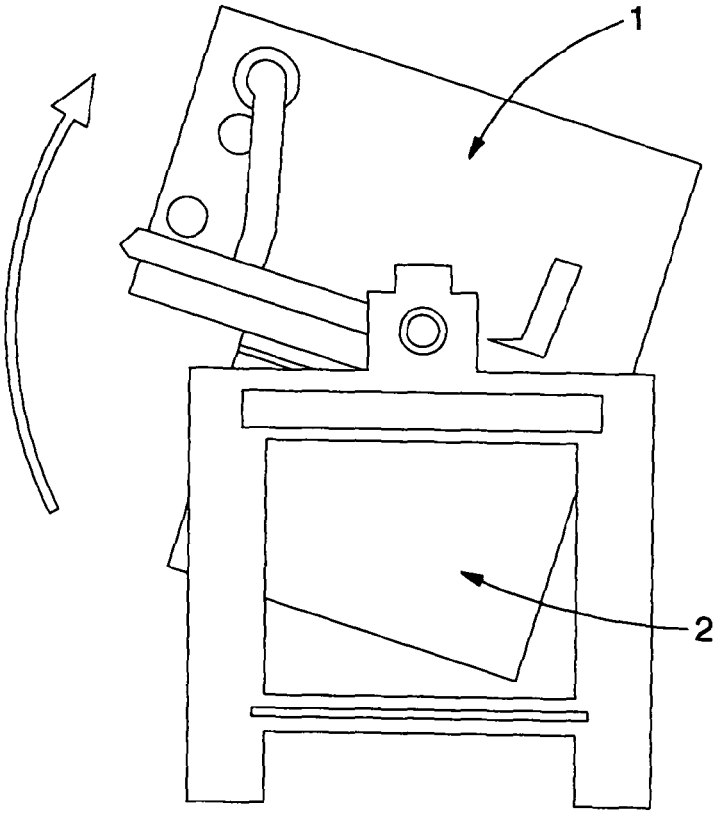
FIG. 1 shows a rotating oven of the invention.

Referring to FIG. 1 a rotating oven is shown. The oven comprises a processing chamber 1 and a charging box 2 attached to the processing chamber that allows the waste to be added to and removed from the oven. The principle fundamentals of the way in which this oven works can be found in prior art document WO 2004/059229. Waste material to be processed is loaded into the charging box which is then attached to the oven. The oven is rotated as the material therein is heated to cause it to break down. The material may be heated in a zero or a substantially zero % oxygen environment during a pyrolysis process therein to create gas. As can be seen the oven is substantially cuboid in shape but may be other shapes having at least one substantially flat side.

Although the prior art is described as having an integral afterburner to combust the gases being produced it would be appreciated that this afterburner may be separated from the oven and connected thereto by a conduit. It will be appreciated by the skilled person that the afterburner can either act to burn the gases produced in the chamber to produce heat that may be usable, for example, for driving a boiler. Alternatively, the afterburner could be provided with a source of fuel and a source of oxygen to burn the fuel so that the gas in the vicinity of the afterburner that has originated from the processing chamber is heated to a high temperature so as to destroy any volatile organic compounds (VOCs) therein but is not in fact combusted. In this way a clean fuel gas can be produced which can be, for example, combusted in a gas turbine. Various modifications to the process parameters to achieve slightly different results depending upon the exact material being processed will be apparent to the skilled person.

Figure 2:
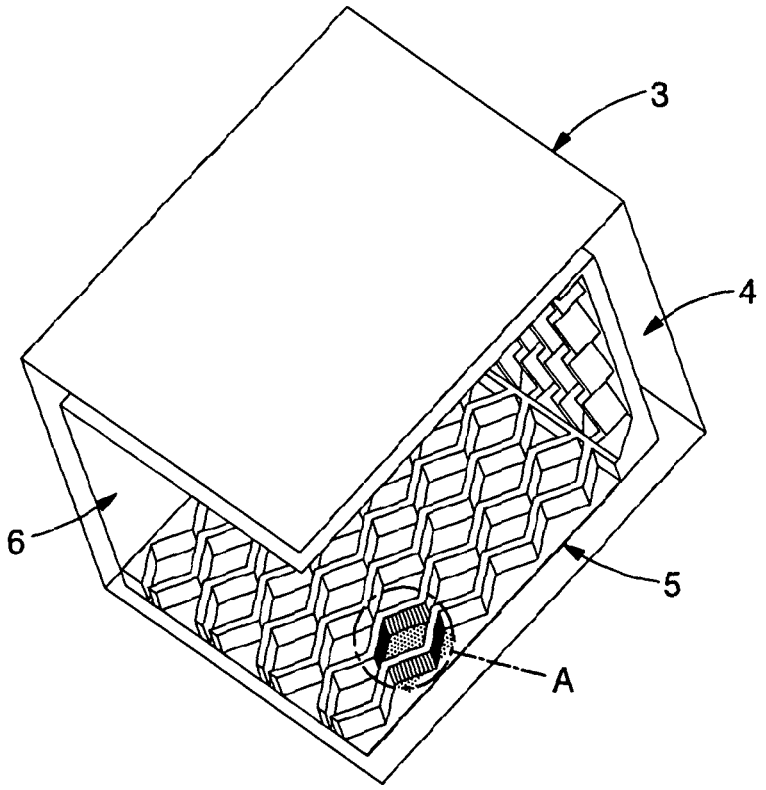
FIGS. 2 and 3 show a partially cut away chamber of the over of the invention.
Figure 3:
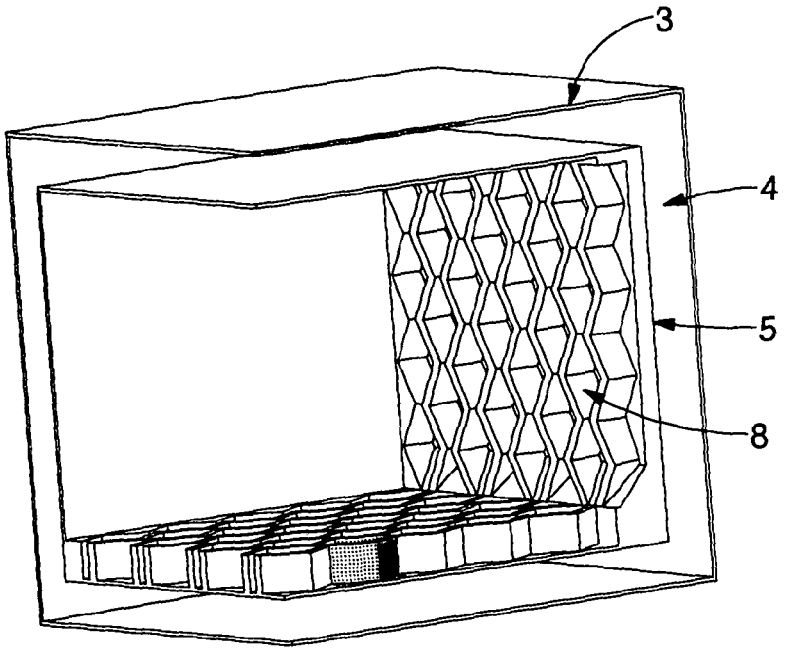
Figure 4:
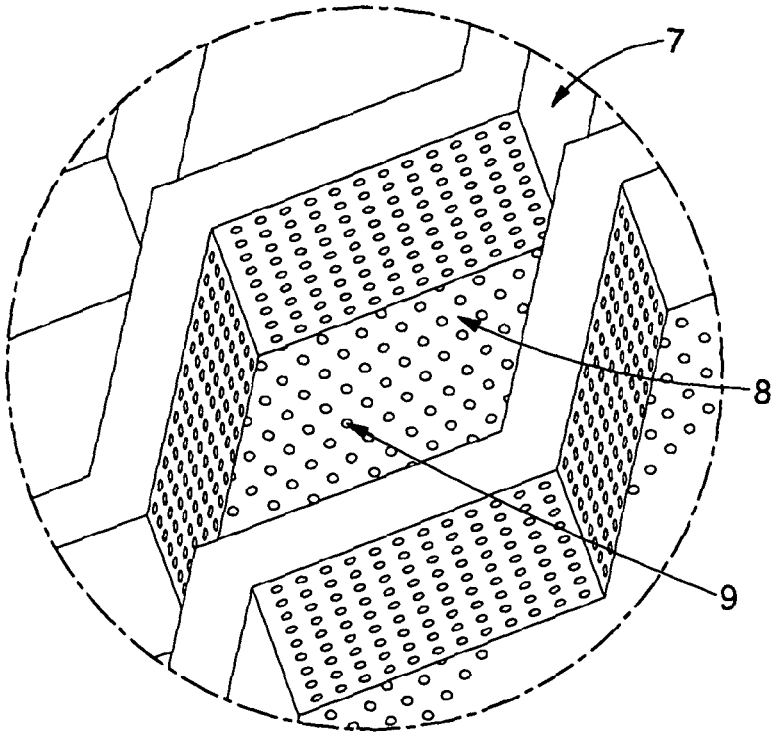
FIG. 4 shows an isometric enlarged detail view A of a section of the chamber in FIG. 2 and shows the details of the pocket in a processing chamber of the present invention.

Referring now to FIGS. 2 to 4 a partial section through a processing chamber 1 of the oven is shown. The processing chamber 1 has a double walled construction having an outer wall 3 and an inner wall 5. The processing chamber 1 has an open end 6 through which material may enter the processing chamber from the charging box (2, see FIG. 1). Pluralities of pockets 8 are provided and formed within the construction of the inner chamber wall 5. It will be appreciated that an example array of pockets 8 are shown, but the shape size and number may be altered. In particular an XY array of pockets may be provided on more than one side of the processing chamber. As the processing chamber 1 is rotated material therein moves within the oven enters the pockets. As the oven continues to rotate the material in the pockets is prevented from sliding en mass from one side of the chamber to the other. Furthermore any material above the pockets will not slide so quickly over the surface thereof as it would in a flat sided chamber, Depending on the nature of the material being processed interference between the material in the pockets 8 and that above the pockets 8 may retard the movement of the material that is not in the pockets 8 as the oven rotates.

By separating the material into the different pockets as the oven rotates the volume of material is broken down into smaller amounts. As can be seen the sidewalls between the pockets are substantially hollow to receive a hot flow of gas therethrough so as to heat the sidewalls. Furthermore the sidewalls and the bottom wall of the pockets are provided with a plurality of hot gas inlet holes 9 therein through which gas may flow into the material being processed to cause it to become heated.

As can be seen the pockets 8 are substantially rhombus shaped and are arranged in rows. An opening or gap 7 is provided between adjacent pockets 8 in the same row. The oven 1 rotates in a direction aligned with the rows of pockets so that the gravitational forces on the material as the oven rotates is aligned with the rows of pockets 8 and their open ends 7. As the material is processed its volume will reduce and once small enough to pass through the gaps 7 the material will move from the pocket and new material will take its place. As described, while the material is retained in the pockets 8, the inlet gas passes from the cavity 4 and through the inlet holes 9 in the sides and bottom of the pocket surrounding the material, thereby increasing its exposure to heat. After material has exited the pockets the rotation of the oven causes the pockets 8 to be replenished with larger pieces of material to repeat the function until finally all the material has been broken down into, essentially dust and the process is then complete.

The shape of the pockets 8, are such that an optimum angle is created for the material type to encourage bridging of the gap 7 in each pocket during the process until the material in each pocket has been sufficiently broken down and is able to fall through the gap 7, whilst the oven chamber is rotated. By enabling bridging the pockets can retain material therein as the oven rotates as the material in the pocket becomes self supporting thereby restricting it from passing out of the gap 7 before it has been processed down to a certain size. The end angle of the pockets 8 is in the range of 45 to 90 degrees. The actual angle will be determined by the material being process and although the angle range is preferred there may be angles outside this range which are applicable to specific materials.

As seen in FIG. 4 more detail of the pockets 8 are shown. Each pocket 8 contains a plurality of gas inlet holes, 9 and a suitable gap 7. The passage of the hot gas in the gap, 4 between the outer wall 3 and the inner wall 5 heats the inner wall 5 so that any material to be processed that is in contact with the inner wall is heated by means of conduction by the inner wall 3.

In use the purpose of the pockets 8 is to maximise the exposure of the waste material to the incoming hot gases and the sides of the processing chamber that become heated by the passage of the gases thereover.

Figure 5:
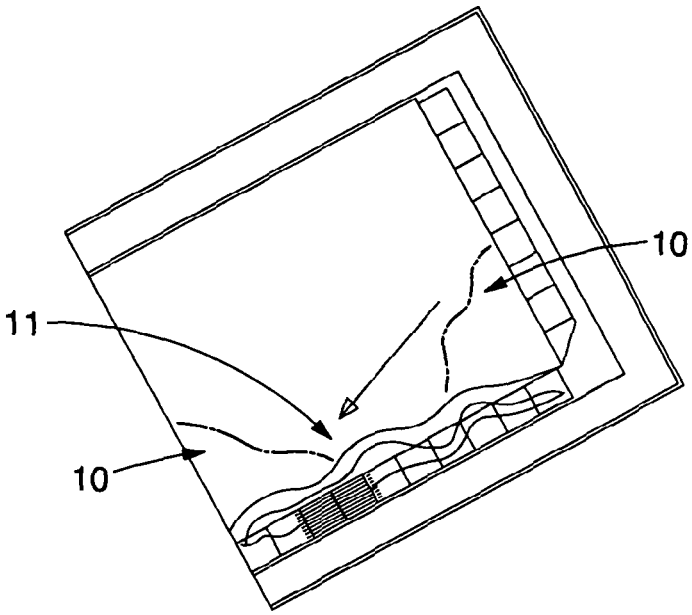
FIG. 5 shows the movement of the material in bulk, shown in dashed lines, compared to the movement of material with the pocket retarder means installed.

Referring to FIG. 5, generally, when an oven of the prior art, having substantially flat internal sides, rotates the material therein tends to move as a single mass as the oven rotates, that is, as the oven rotates the material does not initially move due to static friction between the material and the side of the chamber. Once the rotation reaches a certain level the static friction is overcome and, as the kinetic friction is less than the static friction the material moves across the surface of the chamber (as depicted by the arrow) as a single mass from a first position to a second position depicted by the dashed lines. By moving in this way the lump of material 10, has a low surface area in contact with the walls of the chamber and there will be a large area of heated chamber wall 5 that is not in contact with the material in either position. This increases the time taken to get heat into the material and thereby increases its processing time.

By comparison with the apparatus and method of the present invention, the material 11 is spread more evenly when the pockets 8 are installed and serve to slow the movement, so that the material does not all move as one mass. This has two effects. Firstly the surface area/volume ratio of the material is increased and secondly a larger amount of that area is in contact with the heated walls of the treatment chamber. In particular the heated sidewalls of the pockets increase the heated surface area in contact with the material.

As well as retaining the material in the pockets, the free material not retained in the pockets, when moving in the oven, must pass over the top surface of the material retained in the pockets. This has two further effects to slow the movement of material. Firstly the friction of the surface over which the free material must pass is greatly increased and secondly as the material is often irregular in shape there will be interference between the material in the pockets and the free material so the material passing thereover will be likely to catch on the material in the pockets.

It will be appreciated that as the oven continues to rotate and the pockets come to a vertical position, and then beyond the material therein will fall therefrom under gravity. As the material falls it will pass through the heated gas within the processing chamber 1 becoming further heated.

The invention claimed is:

1. Apparatus for pyrolysing or gasifying the organic content of material, including organically coated waste, biomass, industrial waste, municipal solid waste and sludge, having organic content; the apparatus comprising:

an oven having a rotatable processing chamber adapted to receive material for treatment;

a plurality of gas inlets in at least one wall of the processing chamber through which hot gases are introduced into the processing chamber to heat the material therein so as to cause the organic components thereof to pyrolyse or gasify; and a plurality of pockets having open faces turned inwardly towards the inside of the processing chamber on at least one wall of the processing chamber such that, in use, material being pyrolysed or gasified can be received from the processing chamber into the plurality of pockets via said open faces, and be substantially retained therein through an initial rotation of the processing chamber of less than 90 degrees;

wherein the processing chamber has a double wall, comprising an inner wall and an outer wall, extending along at least one of its sides and wherein the pockets are formed on the inner wall so that the inner wall forms a bottom surface of said pockets and the pockets further comprise side walls extending from the inner wall;

wherein the gas inlets are provided on the side walls of the pockets.

2. An apparatus according to claim 1 wherein the processing chamber has at least one substantially flat internal side and said plurality of pockets are on said flat side.

3. An apparatus according to claim 1 wherein the gas inlets are additionally provided on the inner wall forming the bottom surface of the pockets.

4. An apparatus according to claim 1 in which the plurality of pockets are provided in a series of adjacent rows.

5. An apparatus according claim 4 wherein adjacent rows are offset from one another.

6. An apparatus according to claim 4 wherein the adjacent rows of pockets are aligned perpendicular to the axis of rotation and a gap is provided between adjacent pockets in the same row.

7. An apparatus according to claim 5 wherein each gap defines a gap width and each pocket defines a pocket width larger than the gap width such that the gaps between adjacent pockets are configured to prevent material larger than the gap from passing from one pocket to the next pocket as the oven moves through said initial rotation.

8. An apparatus according to claim 7 wherein said pockets taper in the direction of said gap.

9. An apparatus according to claim 4 wherein pockets of adjacent rows have a common side wall.

10. An apparatus according to claim 9 wherein the common side walls comprise a hollow wall structure with a plurality of gas inlets located on either side thereof.

11. An apparatus according to claim 1 wherein the pockets are substantially rhombus shaped.

12. An apparatus according to claim 1 wherein the pockets are provided on at least two walls of the processing chamber.

13. A method of pyrolysing or gasifying the organic content of material having organic content including: organically coated waste, biomass, industrial waste, municipal solid waste and sludge; the method comprising:

providing an apparatus comprising: an oven having a rotatable processing chamber adapted to receive material for treatment; a plurality of gas inlets in at least one wall of the processing chamber through which hot gases are introduced into the processing chamber to heat the material therein so as to cause the organic components thereof to pyrolyse or gasify; and a plurality of pockets having open faces turned inwardly towards the inside of the processing chamber on at least one wall of the processing chamber so that, in use, material being pyrolysed or gasified can be received from the processing chamber into the plurality of pockets via said open faces, and be substantially retained therein through an initial rotation of the processing chamber of less than 90 degrees;

the processing chamber having a double wall, comprising an inner wall and an outer wall, extending along at least one of its sides and wherein the pockets are formed on the inner wall and wherein the pockets further comprise a bottom surface and side walls extending from the inner wall, the gas inlets being provided on the bottom surface and on the side walls of the pockets; and placing material to be treated in the oven;

heating the material in the processing chamber by introducing hot gases thereinto via said plurality of gas inlets;

rotating the processing chamber so as to cause the material therein to move; wherein at least some of the material is received in the pockets so that the pockets retard the movement of the material in the processing chamber as it rotates.

14. The method of claim 13 wherein the processing chamber has at least one substantially flat internal side and wherein the pockets slow the movement of waste material as the processing chamber rotates to prevent the material therein from moving substantially as one mass from its position to a new position substantially at the lowest point of the chamber.

15. The method of claim 13 wherein the plurality of pockets are provided in a series of adjacent rows with a gap being provided between adjacent pockets in the same row, and wherein the processing chamber is rotated in a direction perpendicular to the rows.

* * * * *